US005709074A

United States Patent [19]

Stahlecker

[11] Patent Number: 5,709,074

[45] Date of Patent: Jan. 20, 1998

[54] OPEN END SPINNING ROLLER WITH EXCHANGEABLE COMBING RING

[75] Inventor: Fritz Stahlecker, Josef-Neidhart-Strasse 18, 73337 Bad Überkingen, Germany

[73] Assignees: Fritz Stahlecker, Bad Überkingen; Hans Stahlecker, Süssen, both of Germany

[21] Appl. No.: 700,928

[22] Filed: Aug. 23, 1996

[30] Foreign Application Priority Data

Aug. 30, 1995 [DE] Germany ..... 195 31 910.9

[51] Int. Cl.[6] ..... D01H 4/00

[52] U.S. Cl. ..... 57/408; 19/112; 19/114; 57/412

[58] Field of Search ..... 57/408, 409, 410, 57/411, 412, 413; 19/112, 114, 97

[56] References Cited

U.S. PATENT DOCUMENTS

| | | | |
|---|---|---|---|
| Re. 33,190 | 4/1990 | Stahlecker | 57/408 |
| 4,300,265 | 11/1981 | Heinen | 57/408 |
| 4,805,395 | 2/1989 | Stahlecker et al. | 19/97 |
| 4,894,923 | 1/1990 | Schmid | 19/97 |
| 4,939,897 | 7/1990 | Schmolke | 57/408 |
| 5,085,047 | 2/1992 | Hofmann | 57/408 |
| 5,465,567 | 11/1995 | Schmolke et al. | 19/112 |

*Primary Examiner*—William Stryjewski
*Attorney, Agent, or Firm*—Evenson McKeown Edwards & Lenahan, PLLC

[57] ABSTRACT

An opening roller for an open-end spinning arrangement includes a combing ring which is slipped onto a base body and supported between two clamping surfaces. The combing ring is provided with centering surfaces at the end areas of its inner circumference. It is slipped with one of the centering surfaces onto a correspondingly formed guiding surface of the base body with a light sliding fit. The other centering surface serves to center a lid-like clamping member which comprises one of the two clamping surfaces. The clamping member is preferably provided with centering ribs, whose outer contour diameter is adapted to the relevant centering surface of the combing ring. The clamping member is attached to the base body, or to a component (shaft of the opening roller) connected thereto in such a way that sufficient radial displacement for centering at the combing ring is possible.

22 Claims, 2 Drawing Sheets

OPEN END SPINNING ROLLER WITH EXCHANGEABLE COMBING RING

BACKGROUND AND SUMMARY OF THE INVENTION

The present invention relates to an opening roller for an open-end spinning arrangement comprising a combing ring which is slipped onto a base body and supported between two clamping surfaces. The combing ring has stopping surfaces at its end faces arranged to engage the clamping surfaces and centering surfaces in the end areas of its inner circumference, of which one centering surface is arranged at the base body and the other at a lid-like clamping member which comprises one of the clamping surfaces.

In the case of opening rollers of this type, the clamping member is usually slipped onto a centering guide of the base body or onto the shaft of the opening roller carrying the base body (U.S. Pat. No. 4,300,265). The known clamping members center the combing ring in one end area, while the combing ring is centered at its other end area by a corresponding cylindrical guiding surface of the base body. As a result, redundancies arise with respect to the centering surfaces, so that it is necessary to provide sufficiently large tolerances at the respective centering surfaces. This leads to disadvantages in relation to the truth of rotation of the opening roller.

It is an object of the present invention to create an opening roller which can be made with smaller tolerances and whose rotational balance is thereby improved.

This object has been achieved in accordance with the present invention by providing that the clamping member is centered radially exclusively by the centering surface of the combing ring arranged thereto.

As the combing ring is now centered exclusively at the base body and the clamping member is centered exclusively at the combing ring, all redundancies in relation to the observed tolerances are omitted. The relevant fits can be made smaller, whereby imbalances are reduced.

In a preferred embodiment of the present invention, the clamping member is secured to the base body, or to a component attached thereto, by means of at least one securing means which permits radial displacement. In the case of a component attached to the base body, this can be the shaft which drives the opening roller.

The clamping member is preferably provided with so-called centering ribs, for example with three centering ribs which are distributed over the circumference of the lid-like clamping member spaced from one another by an angle of 120°. There are only a few points provided for guiding and centering the clamping member in the combing ring, so that larger areas of the clamping member have absolutely no contact with the relevant centering surface of the combing ring. This is particularly advantageous in the case of thin-walled combing rings, which are frequently somewhat oval inside and re-form elastically into a circular contour by means of the centering ribs. The combing ring lies constantly under tension on the centering ribs, so that the clamping member is exactly centric.

In order to simplify assembly, the centering ribs can have a guiding slope. Slipping the clamping member into the combing ring takes place hereby without any difficulties, even if the combing ring is somewhat oval before assembly.

In a further embodiment of the present invention the centering ribs may be resilient in radial direction. They then can give when the clamping member is being slipped on, even if the amount involves only hundredths of a millimeter. This is in particular possible when the clamping member is made of plastic. It is possible to make the clamping member by injection molding to such a degree of exactness that the outer contours of the centering ribs do not require any finishing work.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
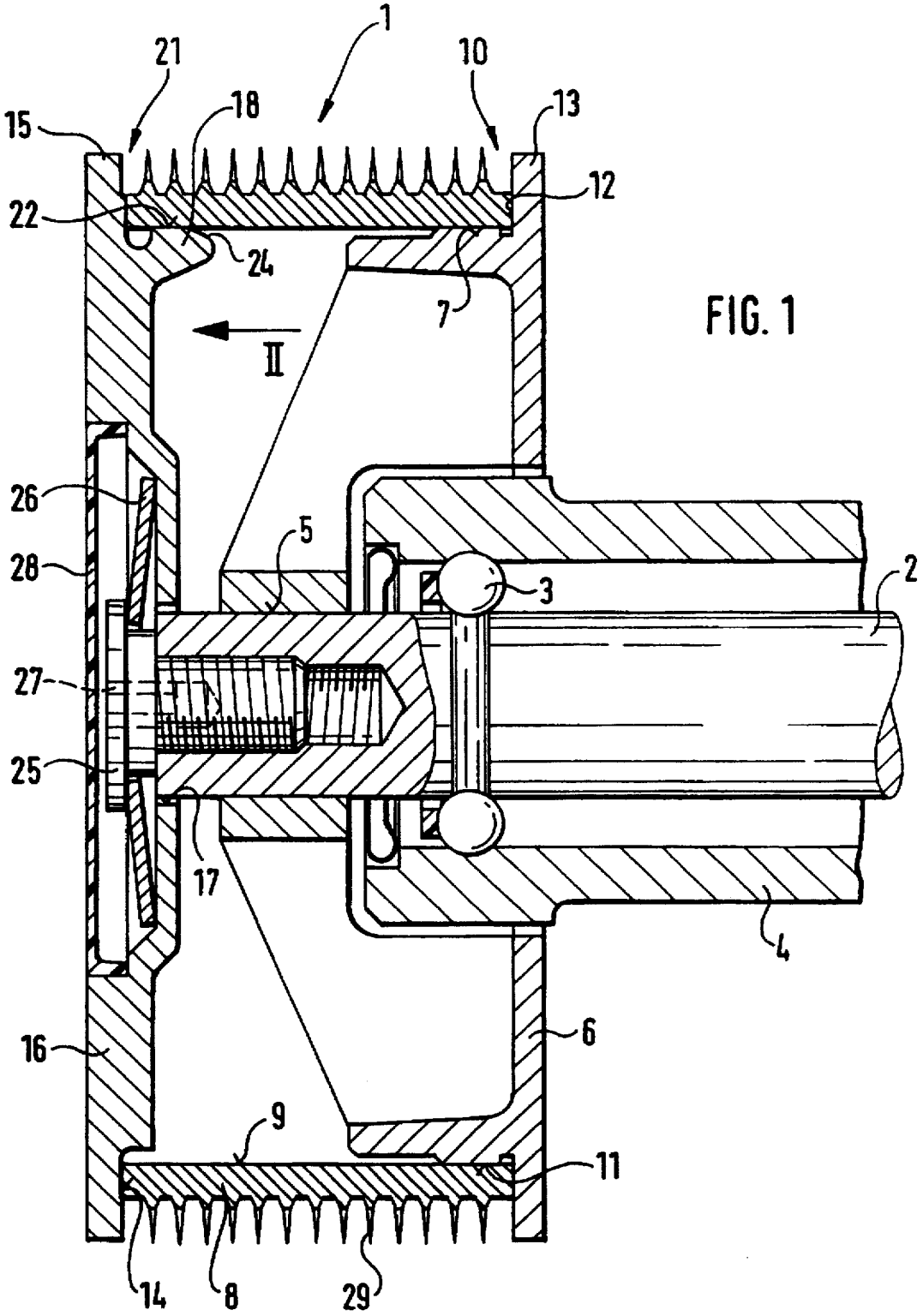
FIG. 1 is an axial section through an opening roller constructed according to a preferred embodiment of the invention.

The opening roller in FIG. 1 denoted in its entirety by the reference number 1 is applied to a shaft 2, which is supported by means of bearings 3 in a bearing housing 4. The end of the shaft 2 projects beyond the bearing housing 4 and is provided there with a drive wharve for a drive belt (not shown).

A base body 6 of the opening roller 1 is pressed onto the shaft 2 by means of a press fit 5. The base body 6 has a preferably cylindrical guiding surface 7 in the area of its outer circumference, on which guiding surface 7 a combing ring 8 with a lightly detachable sliding fit is slipped. On the inner circumference 9 of the combing ring 8 a centering surface 11 is arranged at the guiding surface 7, which centering surface 11 is located in the end area 10 of the combing ring 8.

The combing means 29 is ground out of a hardened ring of steel and thus made in one Piece with the combing ring 8.

After the combing ring 8 has been slipped onto the base body 6, it rests with an end face stopping surface 12 against a base body flange 13 which takes the form of a clamping surface. The opposite end face stopping surface 14 of the combing ring 8 is braced in relation to the flange 13 of the base body 6 by means of a clamping surface which is formed by a flange 15 of a lid-like clamping member 16.

The clamping member 16 comprises a centrical bore hole 17 which is large enough to allow the clamping member 16 to be slipped onto the end of the shaft 2 and thereafter to still permit radial displacement of the clamping member 16.

Figure 2:
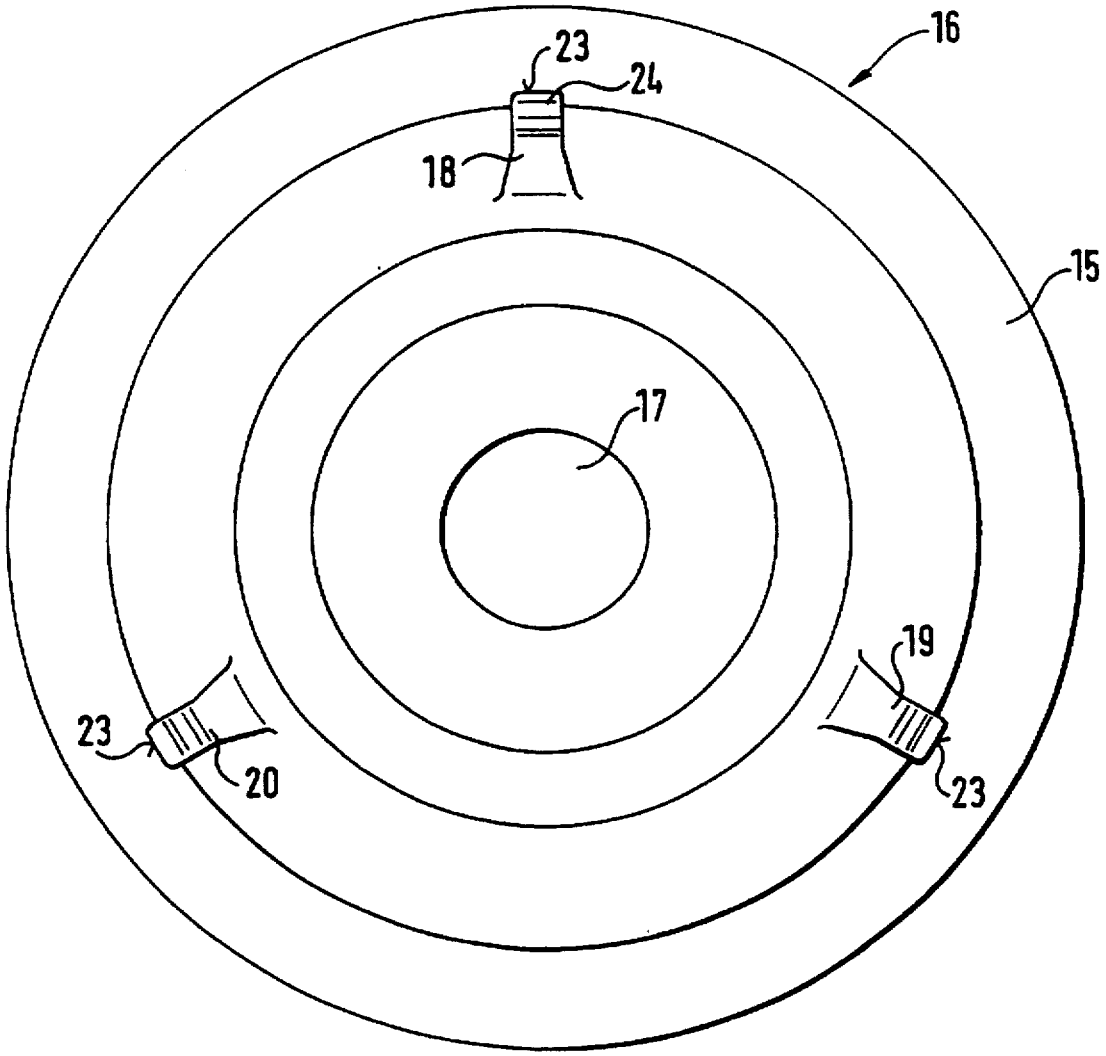
FIG. 2 is a view of the clamping member of the opening roller, as seen in the direction of the arrow II of FIG. 1.

As can be seen in particular in FIG. 2, the clamping member 16 is provided with preferably three centering ribs 18, 19 and 20. By means of these centering ribs 18, 19 and 20 the clamping member 16 is centered to a centering surface 22 of the combing ring 8. The centering surface 22 is located in that end area 21 of the inner circumference 9 of the combing ring 8 which faces away from the flange 13 of the base body 6.

The diameters of the outer contours 23 of the centering ribs 18, 19 and 20 are so formed that they are adapted to the centering surface 22 of the combing ring 8. Here a light clearance fit is preferred. To simplify assembly, the centering ribs 18, 19 and 20 are each provided with a guiding slope 24.

In another embodiment, the centering ribs 18, 19 and 20 can be resilient in radial direction, which is made possible in particular preferred embodiments by having the clamping member 16 made of plastic. In this case, a clearance fit between the centering ribs 18, 19 and 20 and the centering surface 22 of the combing ring 8 is not necessary. As a result of the guiding slope 24 and the radial resilience, the centering ribs 18, 19 and 20 can be guided into the combing ring 8 under light tension in this embodiment.

The clamping member 16 is axially secured by a securing means 25 in the form of a screw which is screwed into a centrical threaded bore hole of the shaft 2. The head of the screw is supported by a disc spring 26 and is provided with working surfaces 27 for a tool.

After assembly of the combing ring 8, the area of the securing means 25 is covered by a plastic cap 28 which is pressed into the clamping member 16, so that a flat front surface arises for the clamping member 16 towards the tending side. The cap 28 can be easily removed from the clamping member 16 for releasing the securing means 25 (not shown).

In another embodiment (not shown), instead of the securing means 25 in the form of a centrical screw, a plurality of screws, preferably three, can be used distributed over the periphery of the clamping member 16, with which screws the clamping member 16 is screwed to the base body 6 in a generally known manner.

Not further illustrated embodiments are contemplated where the centering ribs 18, 19 and 20 are omitted, and a cylindrical collar on the clamping member 16 is used instead. In order to form a guiding slope on the collar, its end can be slightly conical in shape.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An opening roller for an open-end spinning arrangement comprising a combing ring which is slipped onto a base body and supported between two axially opposed clamping surfaces, said combing ring being provided at its axial end faces with stopping surfaces arranged at the clamping surfaces, axial end areas of the inner circumference of the combing ring having centering surfaces, of which one centering surface is arranged at the base body and the other centering surfaces arranged at lid-like clamping member, said clamping member comprising one of the clamping surfaces and being centered radially with respect to the base body exclusively by the centering surface of the combing ring arranged thereat.

2. An opening roller according to claim 1, wherein the clamping member is secured to the base body, or a component connected thereto, by at least one radial displacement accommodating member which in use accommodates radial displacement of the clamping member with respect to the base body.

3. An opening roller according to claim 2, wherein the clamping member is provided with three centering ribs which in use engages the associated centering surface of the combing ring.

4. An opening roller according to claim 3, wherein the clamping member is provided with three centering ribs which in use engages the associated centering surface of the combing ring.

5. An opening roller according to claim 4, wherein the centering ribs resilient in radial direction.

6. An opening roller according to claim 5, wherein the clamping member is make of plastic.

7. An opening roller according to claim 3, wherein the centering ribs are resilient in radial direction.

8. An opening roller according to claim 3, wherein the clamping member is make of plastic.

9. An opening roller according to claim 2, wherein the clamping member is made of plastic.

10. An opening roller according to claim 1, wherein the clamping member is provided with three centering ribs which in use engages the associated centering surface of the combing ring.

11. An opening roller according to claim 10, wherein the clamping member is provided with three centering ribs which in use engages the associated centering surface of the combing ring.

12. An opening roller according to claim 11, wherein the clamping member is made of plastic.

13. An opening roller according to claim 10, wherein the centering ribs are resilient in radial direction.

14. An opening roller according to claim 10, wherein the clamping member is made of plastic.

15. An opening roller according to claim 1, wherein the clamping member is made of plastic.

16. An opening roller assembly for an open end spinning machine comprising:

a base body supportable at an opening roller shaft, said base body including a radially extending clamping surface and an axially extending centering surface section, a clamping member supportable at the opening roller shaft for radial movement with respect to the opening roller shaft at a position axially spaced from the base body, said clamping member including a radially extending clamping surface and axially extending centering surface section, and a combing ring clamped between the clamping surfaces of the base body and clamping member, wherein said axially extending support surfaces at the base body and clamping member are axially spaced from one another, and wherein said clamping member is centered radially with respect to the base body exclusively by centering surface sections of the combing ring engaging with the centering surface sections of the clamping ring.

17. An opening roller assembly according to claim 16, wherein said axially extending centering surface sections on the clamping member are disposed on a plurality of ribs on the clamping member.

18. An opening roller assembly according to claim 17, wherein said plurality of ribs is three ribs.

19. An opening roller assembly according to claim 18, wherein each of the ribs has a tapered combing ring guiding surface at an end of said ribs opposite said clamping surface of the clamping member.

20. An opening roller assembly according to claim 16, wherein said clamping ring is an annular plastic ring which is connected to the roller shaft by at least one threaded member and a clamping spring.

21. A method of manufacturing an opening roller assembly for an open end spinning machine, said method comprising:

providing an opening roller shaft, attaching a base body to the roller shaft with said base body exhibiting a radially extending clamping surface and an axially extending guiding centering surface, sliding a substantially cylindrical combing ring over the centering surface of the base body with one end of said combing ring abutting the clamping surface of the base body, detachably attaching a clamping disk member to the roller shaft while allowing limited radial movement of the clamping disk member, which clamping disk member has a clamping surface engageable with an opposite end of the combing ring to clamp the combing ring in position, said clamping disk member including centering surface sections engageable with a radially internal surface section of the combing ring to radially center the clamping ring independently of the centering of the clamping at the base body centering surfaces.

22. A method according to claim 21, wherein the clamping disk member includes three ribs which form the centering surface sections for radially centering the clamping disk member on the combing ring.

* * * * *